US006077198A

United States Patent [19]

Eschenbach

[11] Patent Number: 6,077,198

[45] Date of Patent: Jun. 20, 2000

[54] SELECTIVE LIFT CROSS TRAINER EXERCISE APPARATUS

[76] Inventor: Paul William Eschenbach, 143 Lakeland Ave., Moore, S.C. 29369

[21] Appl. No.: 09/385,093

[22] Filed: Aug. 30, 1999

[51] Int. Cl.[7] ..... A63B 69/16; A63B 22/04

[52] U.S. Cl. ..... 482/52; 482/57

[58] Field of Search ..... 482/51–53, 57, 482/70, 79, 80, 148

[56] References Cited

U.S. PATENT DOCUMENTS

| | | | |
|---|---|---|---|
| 5,383,829 | 1/1995 | Miller | 482/57 |
| 5,562,574 | 10/1996 | Miller | 482/51 |
| 5,685,804 | 11/1997 | Whan-tong et al. | 482/51 |
| 5,993,359 | 11/1999 | Eschenbach | 482/51 |

*Primary Examiner*—Stephen R. Crow

[57] ABSTRACT

The present invention relates to a standup exercise apparatus that simulates walking, jogging and climbing with arm exercise. More particularly, the present invention relates to an exercise machine having separately supported pedals for the feet and arm exercise coordinated with the motion of the feet.

Cross trainers guide the feet along a generally elliptical shaped curve to simulate the motions of jogging and climbing. Existing machines often produce user problems such as excessive foot articulation. The present invention is an improved elliptical exercise machine capable of extended exercise with fewer user problems. Further, the cross trainer is adjustable to vary the motion of the elliptical stride from walking to climbing.

A foot support member is guided by a guide linkage on one end and driven by a crank linkage on the other end. The resulting pedal motion has less severe pedal angles than a simple crank cross trainer. Handles are coupled to the guide linkage for coordinated arm exercise.

30 Claims, 4 Drawing Sheets

SELECTIVE LIFT CROSS TRAINER EXERCISE APPARATUS

BACKGROUND OF THE INVENTION

1. Field

The present invention relates to a standup exercise apparatus that simulates walking, jogging and climbing with arm exercise. More particularly, the present invention relates to an exercise machine having separately supported pedals for the feet and arm exercise coordinated with the motion of the feet. The pedal lift is controlled separately and can be varied.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve to simulate the motions of jogging and climbing. Generally they are large exercise machines using long cranks to generate a long foot stride. There is a need for a more compact elliptical exercise machine capable of a similar long stride using a crank linkage. Further, there is a need to adjust lift of the elliptical motion to vary the amount of climb desired by the operator during operation.

Numerous combinations of levers and cranks to combine exercise for arms and feet can be found. Hex in U.S. Pat. No. 4,645,200 combines arm and foot levers for sit down exercise while Bull et al. in U.S. Pat. No. 4,940,233 combines arm and foot levers for standup exercise. Lucas et al. in U.S. Pat. No. 4,880,225 offer oscillating arm levers coupled to the foot crank by a connecting rod. Dalebout et al. in U.S. Pat. Nos. 4,971,316 and 5,000,444 also shows oscillating swing arms coupled to the foot crank by an offset second crank and connecting rod. Lom in U.S. Pat. No. 4,986,533 offers oscillating arms driven by a crank-slider coupled to a foot crank.

Recently, there has been an effort to improve the up and down motion of stair climbers by the addition of horizontal movements. Habing in U.S. Pats. No. 5,299,993 and 5,499,956 offers an articulated linkage controlled through cables by motor to move pedals through an ovate path. Both pedal pivots follow basically the same guidance path curve directed by a motor controller. Stearns in U.S. Pat. Nos. 5,290,211 and 5,299,993 shows a stair stepping exercise machine which incorporates horizontal movement using a combination of vertical parallelogram linkage and horizontal parallelogram linkage to guide the foot pedals. The parallelogram linkages serve to maintain the pedal at a constant angle relative to the floor during a pedal cycle. The pedal pivots move through similar undefined guide paths.

Standup cycling is described in various patents such as U.S. Pat. No. 3,563,541 (Sanquist) which uses weighted free pedals as load resistance and side to side twisting motion. Also U.S. Pat. Nos. 4,519,603 and 4,477,072 by DeCloux describe standup cycling with free pedals in a lift mode to simulate body lifting.

Standup pedal exercise is shown in U.S. Pat. No. 4,643,419 (Hyde) and by Jarriel et al. In U.S. Pat. No. D330,236 where pedal platforms move by dual crank motion but remain parallel to the floor. Knudsen in U.S. Pat. No. 5,433,680 shows an elliptical path generating mechanism with pedals having only one pivot allowing the pedal to rotate unconstrained about the pivot as in a bicycle crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

Recently, numerous elliptical exercise machines have appeared in the patent literature. Rogers,Jr. in U.S. Pat. Nos. 5,527,246, 5,529,555, 5,540,637, 5,549,526, 5,573,480, 5,591,107, 5,593,371, 5,593,372, 5,595,553, 5,611,757, 5,637,058, 5,653,662 and 5,743,834 shows elliptical pedal motion by virtue of various reciprocating members and geared linkage systems. Miller in U.S. Pat. Nos. 5,518,473, 5,562,574, 5,611,756, 5,518,473, 5,562,574, 5,577,985, 5,755,642 and 5,788,609 also shows elliptical pedal motion using reciprocating members and various linkage mechanisms along with oscillating guide links with control links to determine pedal angles. Ryan et al. in U.S. Pat. No. 5,899,833 shows an elliptical cross trainer having a forward crank driving a pedal linkage underneath the operator.

Chang in U.S. Pat. No. 5,803,872 and Yu et al. in U.S. Pat. No. 5,800,315 show a pedal supported by a rocker link and driven with a pair of links located under the pedal pivotally connected to a crank. Maresh et al. in U.S. Pat. No. 5,792,026 show a foot support member supported by a rocker link and driven by a double crank mechanism. Lee in U.S. Pat. No. 5,779,598 and Chen in U.S. Pat. No. 5,823,914 show a pedal link driven by two separate cranks. Lin et al. in U.S. Pat. No. 5,769,760 offers elliptical foot and hand motion. Sands et al. U.S. Pat. No. 5,755,643 shows elliptical foot motion with folding front post.

Lee in U.S. Pat. No. 5,746,683 shows a foot support member supported on one end with a compound rocker wherein a slider and handle lever support the rocker. Kuo in U.S. Pat. No. 5,836,854 offers a linear foot support member connected on one end to a crank and guided along an arcuate curve under the pedal by a linkage on the other end. Wang et al. U.S. Pat. No. 5,830,112 shows a foot support member sliding on a pivot on one end and attached to a crank on the other that can fold. Chen U.S. Pat. No. 5,823,917 shows a foot support member driven by a crank on one end and supported by a stationary roller on the other. Chen U.S. Pat. No. 5,820,524 offers a slider crank mechanism having a pedal pivotally attached with a control link to articulate the pedal angle.

Chen U.S. Pat. No. 5,779,599 and 5,762,588 shows an elliptical pedal movement with a roller interface between the foot support member and crank. Chen in U.S. Pat. No. 5,759,136 shows a foot support member with a moving pedal for adjustable elliptical motion wherein a link from the pedal to the crank can be repositioned to change the pedal stroke length. Kuo U.S. Pat. No. 5,846,166 shows a foot support member guided on one end by a roller and driven on the other end by a four bar linkage. Stearns et al. in U.S. Pat. No. 5,848,954 offers a foot support member pivoted on one end with a lift crank on the other and a pedal moving on the foot support member to generate elliptical type foot motion.

Maresh et al. in U.S. Pat. No. 5,893,820 shows an adjustable lift elliptical cross trainer wherein the operator must interrupt exercise to relocate various pins to alter the pedal motion. Kuo U.S. Pat. No. 5,836,854 shows a foot support member driven by a crank and guided on one end by a linkage hanging from a "Z" shaped bar that may be adjusted. Whan-Tong et al. In U.S. Pat. No. 5,685,804 shows a foot support member driven by a simple crank having an adjustable ramp to vary pedal lift. Eschenbach in U.S. Pat. No. 5,916,064 shows handles for arm exercise coupled to a foot support member at one end with a connecting link. Maresh in U.S. Pat. No. 5,895,339 shows a crank linkage that may be moved to vary the stroke of the ellipse.

There is a need for a pedal operated exercise machine that can be safely operated in the standup position whereby the arms and legs can be exercised with the feet moving through a generally elliptical path wherein pedal lift is variable during operation.

It is one objective of this invention to provide an elliptical pedal movement with a crank linkage that reduces the steep pedal angle which can occur with a simple crank. Another object of this invention is to provide arm exercise that is coordinated with the pedal movement which allows pedal lift to be adjusted during operation.

SUMMARY OF THE INVENTION

The present invention relates to the kinematic motion control of pedals which simulate walking, jogging and climbing during operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong or elongate curve motion while pedal angles are controlled to vary about the horizontal during the pedal cycle. Arm exercise is by arm handles coordinated with the foot pedals.

In the preferred embodiment, the apparatus includes a separate pedal for each foot, each pedal is supported by a foot support member which is pivotally attached on one end to a guide link at a guide pivot. Each guide link has motion determined by a pair of control links pivoted to the guide link and pivotally associated with the framework. The guide pivot will follow a generally linear path when the preferred relationship exists between the guide and control links.

The foot support member is driven on the other end by a crank linkage consisting of a pair of crank arms, each having a crank roller rotatably connected to the crank arm for support of one end of the foot support member and an intermediate coupling link connecting the foot support member to an offset in the crank arm. The crank linkage reduces the pedal angles during upper portions of the elliptical motion because the crank end of the foot support member follows an oval instead of an arcuate curve. A crank completes one full revolution during a pedal cycle and is phased generally opposite the crank for the other foot support link through a bearing journal attached to the framework.

An actuator is associated with the framework and a control arm that has one pair of control links pivotally attached to allow the angle the guide pivot path makes with the floor to be adjusted during operation of the exercise machine. The control arm can be repositioned manually or by actuator. The actuator with a suitable control system can be electrically operated with linear movement or other arrangement such as rotary movement intended to reposition the control arm during operation. The control system can interface with the operator during operation.

A pair of handles for arm exercise are attached to the control links for arm exercise. It is understood that the handles for arm exercise could be coupled to the foot support member by another means and remain within the scope of the present invention.

In an alternate embodiment, the crank rollers supporting the foot support member on the crank are replaced with control coupling links pivoted to the crank arms and to the foot support member. The first end of the foot support member follows an oval path. This crank linkage consisting of a pair of crank arms, each with a control coupling link and an intermediate coupling link to produce an elliptical pedal motion similar to the preferred embodiment with less severe pedal angles. The remainder of apparatus is similar to the preferred embodiment.

In an another alternate embodiment, the crank linkage is reduced to a pair of simple crank arms pivoted to the foot support members at the first end which follows an arcuate path. The remainder of the apparatus is similar to the preferred embodiment. While the simple crank is less complex, the pedal angles made with the floor are steeper in the higher pedal positions.

Load resistance is applied to the crank in each embodiment by a pulley which drives a belt to a smaller pulley attached to an alternator and flywheel supported by the framework. In each embodiment, the flywheel must overcome the torque provided by the alternator. Adjustment of the alternator control electronics provides variable intensity exercise for the operator.

In summary, this invention provides the operator with stable foot pedal support having adjustable foot lift during operation that simulate walking, jogging and climbing with very low joint impact and coordinated upper body exercise. The handles for arm exercise are coordinated with the movement of the foot support member to allow adjustments of the foot pedal motion.

DETAILED DESCRIPTION OF THE EMBODIMENTS

Figure 1:
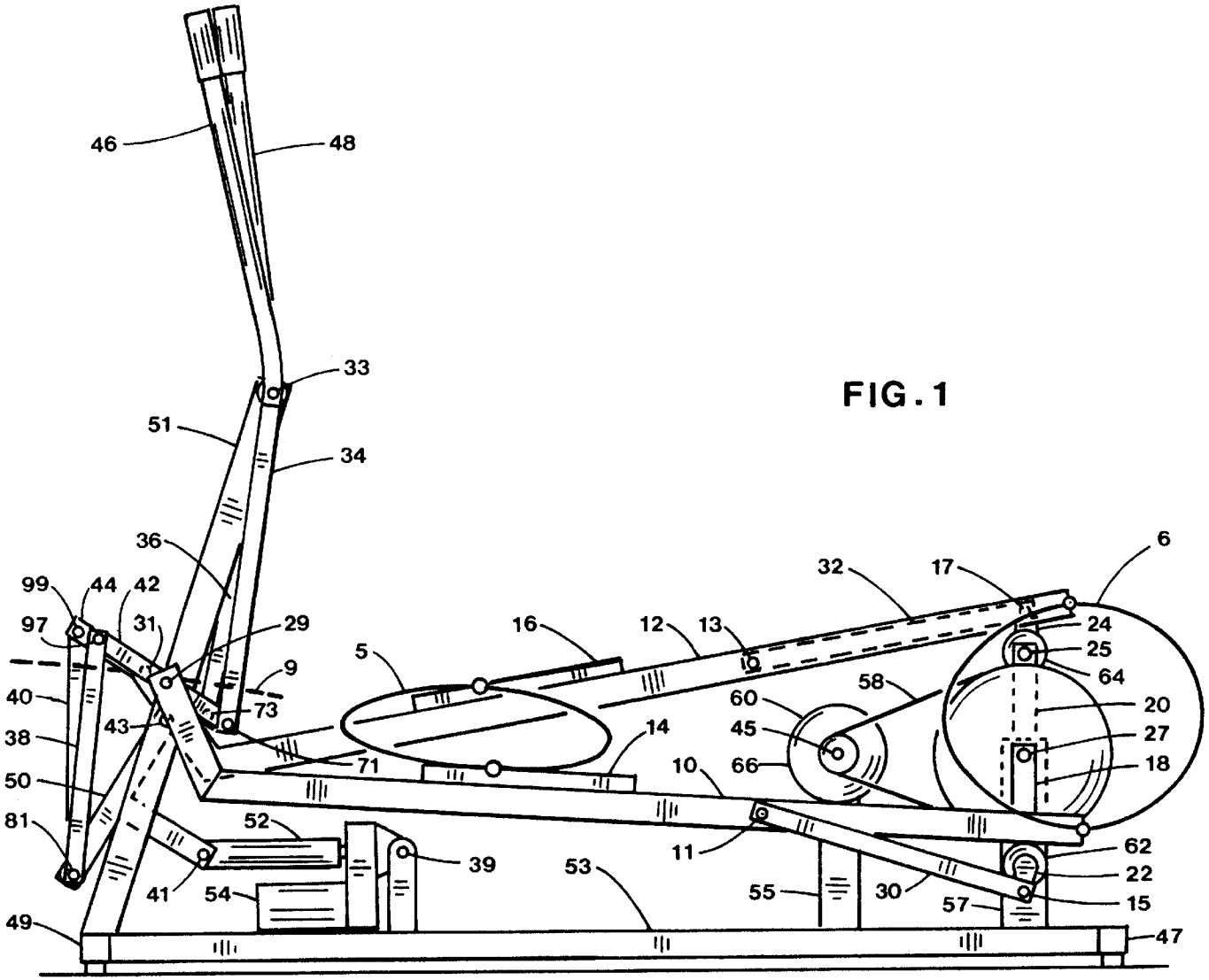
FIG. 1 is a right side elevation view of the preferred embodiment of an exercise machine with the control arm adjusted to a stride position constructed in accordance with the present invention.
Figure 2:
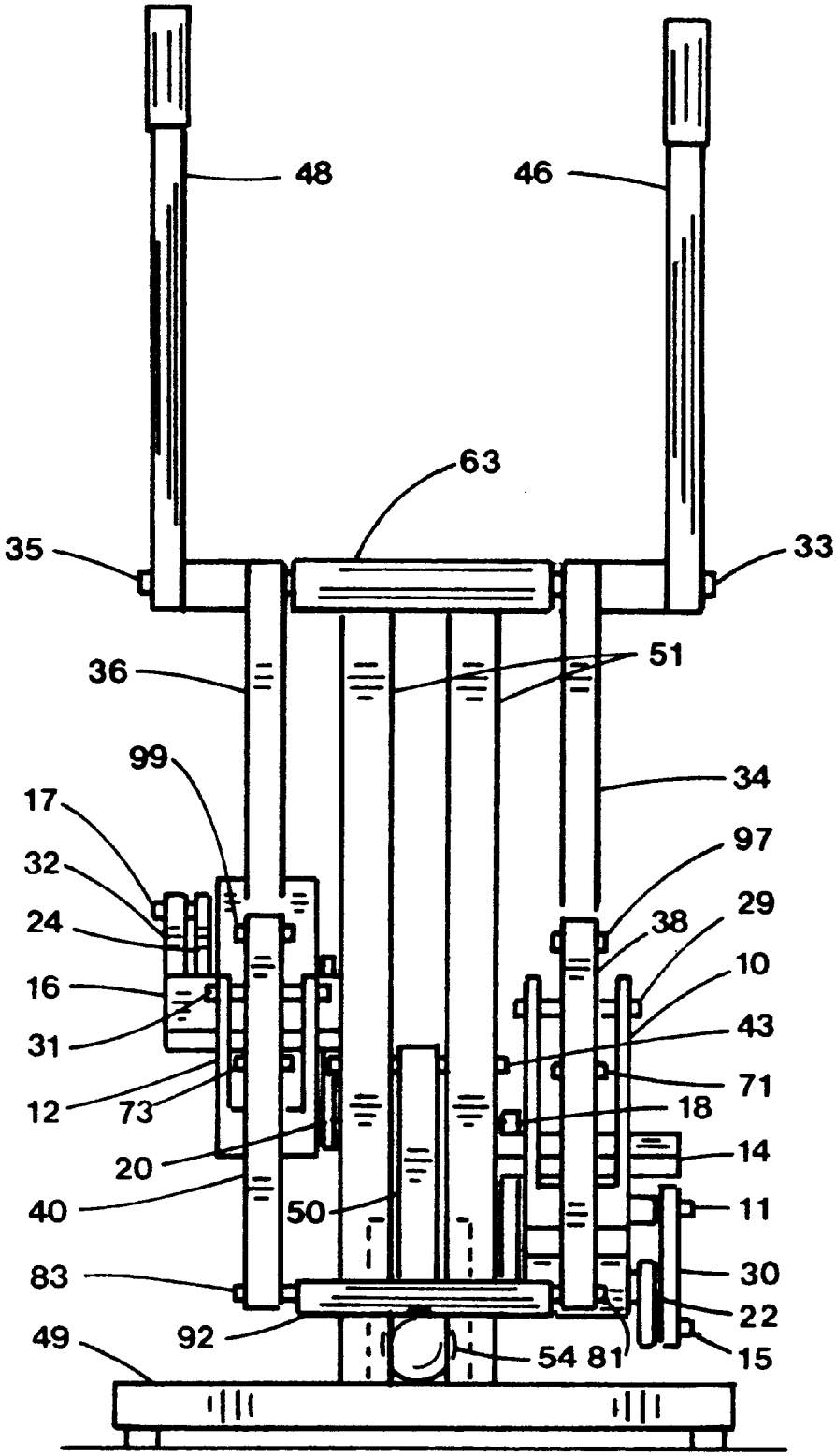
FIG. 2 is the front view of the preferred embodiment shown in FIG. 1.

Referring to the drawings in detail, pedals 14 and 16 are shown in FIGS. 1 and 2 in the lowest and highest positions of the preferred embodiment. Pedals 14 and 16 are attached to foot support members 10,12 which have guide pivots 29,31 at the second end. The first end of foot support members 10,12 rest on crank rollers 62,64 which are rotatably attached to crank arms 18,20 at crank pins 23,25.

Crank arms 18,20 are joined inside bearing housing and frame member 57 protruding outwardly in generally opposing directions to comprise a crank. Further, crank arms 18,20 continue offset in length after pins 23,25 as offset arm portions 22,24 terminating with pivots 15,17. The offset portion 22,24 of cranks 18,20 are shown collinear; however it is understood that non-collinear arrangements are within the scope of the invention. Intermediate coupling links 30,32 are pivoted to foot support members 10,12 at pivots 11,13 and to crank arms 18,20 at pivots 15,17. Crank arms 18,20, crank rollers 62,64 and intermediate links 30,32, form a pair of crank linkage which causes the first end of each foot support member to follow the oval path 6. The oval path 6 allows less severe pedal 14,16 angles during the upper portion of the pedal ellipse 5.

The intermediate portion of guide links 42,44 are attached to the second end of the foot support members 10,12 at guide pivots 29,31. First control links 38,40 are connected to the first end of guide links 42,44 at control pivots 97,99and to control arm 50 at pivots 81,83. Second control links 34,36 are connected to the second end of guide links 42,44 at control pivots 71,73 and to the framework at pivots 33,35. Guide links 42,44, first control links 38,40 and second control links 34,36 comprise a guide linkage to support the second end of foot support members 10,12. The guide linkage proportions and pivot placements shown in FIG. 1 cause guide pivots 29,31 to follow the generally linear path 9.

Control arm 50 is attached to frame member 51 at pivot 43 and to actuator extension 52 at pivot 41. The actuator extension 52 is coupled to actuator 54 which is attached to frame member 53 at pivot 39. Actuator 54 will move actuator extension 52 with linear movement by electric motor which raises or lowers control arm 50. A control system (not shown) provides an interface between the operator and actuator 54 for operator selection of different lift pedal 14,16 motion.

With the control arm 50 stationary as a portion of the framework and crank arms 18,20 rotating, guide pivots 29,31 will follow the generally linear path 9 while pedals 14,16 follow the stride ellipse 5. When the control arm 50 is raised, the angle of linear path 9 increases as does the angle of the major axis of the ellipse 5 for steeper pedal motion. The angle of pedals 14,16 to the horizontal also change. The increased ellipse angle causes higher pedal lift for a climb position. Lower control arm 50 positions provide a stride pedal 14,16 motion.

Handles 46,48 for arm exercise are attached to second control links 34,36 and connected to the frame member 63 at pivots 33,35. Second control links 34,36 are coordinated with foot support members 10,12 to alternately phase handles 46,48 with pedal 14,16 motion.

Frame members 53 connect cross members 47,49 which contact the floor for support of the exercise machine. Frame member 63 attaches to frame member 51 which together with frame members 55 and 57 are attached to frame members 53. Load resistance is imposed upon cranks 18,20 by pulley 56 which drives flywheel/alternator 60 by belt 58 coupled to pulley 66. The flywheel/alternator 60 is supported by the frame member 55 at shaft 45. Other forms of load resistance may also be used.

Application of body weight on the pedals 14,16 causes the pedals 14,16 to follow elliptical curve 5 shown in FIG. 1 and together with force applied at the arm handles 46,48 cause the linkage to rotate the flywheel 60 for a gain in momentum. This flywheel 60 momentum will carry the linkage system through any dead center positions of the crank 18,20. The pedals 14,16 and arm handles 46,48 can be operated to drive the flywheel 60 in either direction of rotation.

Figure 3:
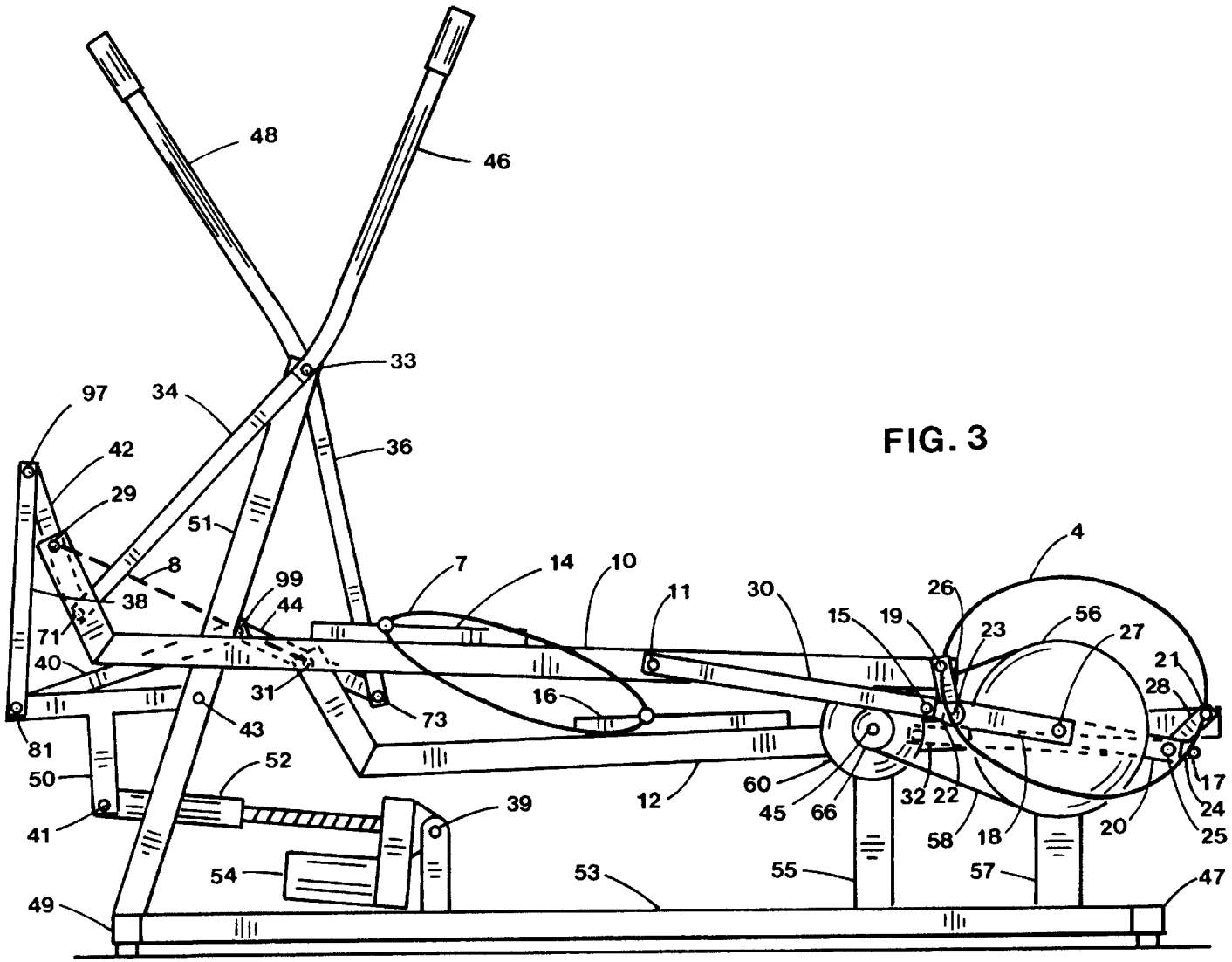
FIG. 3 is a right side elevation view of an alternate embodiment with the control arm adjusted to the climb position.

FIG. 3 shows an alternate embodiment with the pedals 14,16 in the most forward and rearward positions. Guide 50 is in an upper position with actuator extension 52 extended from actuator 54. The pedal path 7 is a steeper ellipse having more pedal lift for a climbing motion. The guide linkage is the same as the preferred embodiment of FIG. 1. Crank rollers 62,64 have been replaced with control coupling links 26,28 which are attached to crank arms 18,20 at pivots 23,25 and to foot support members 10,12 at pivots 19,21. Crank arms 18,20, intermediate coupling links 30,32 and control coupling links 26,28 form a pair of alternate crank linkage wherein pivots 19,21 follow oval path 4. Pivots 19,21 are located at the first end of foot support members 10,12 but could also be relocated elsewhere along foot support members 10,12 within the scope of this invention.

Figure 4:
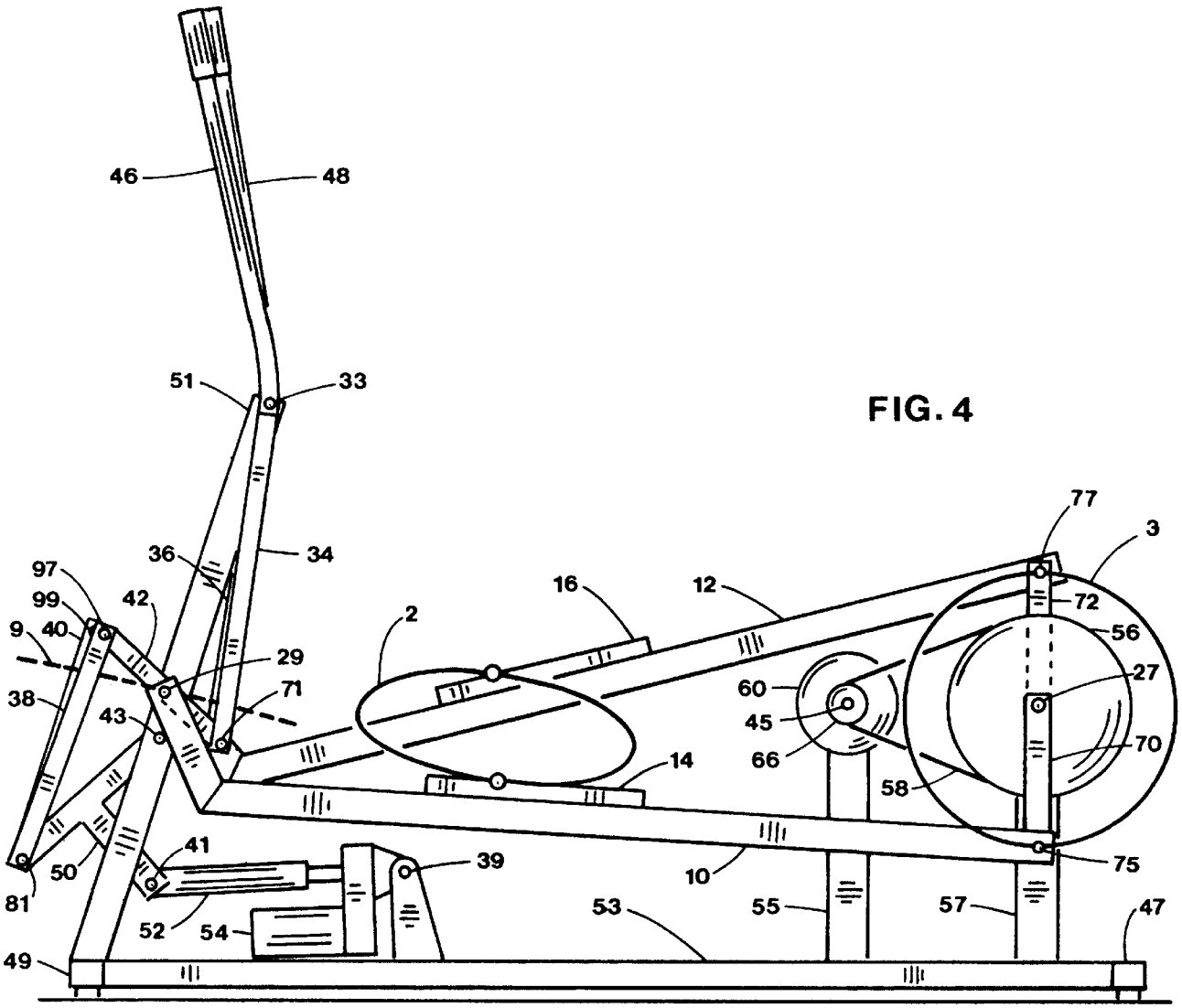
FIG. 4 is a right side elevation of an alternate embodiment with the control arm adjusted to the cross train position.

An alternate embodiment is shown in FIG. 4 with pedals 14,16 in their highest and lowest positions. Simple crank arms 70,72 are connected to the first ends of foot support members 10,12 at pivots 75,77. Pivots 75,77 follow an arcuate curve 3 centered about crank pivot 27. The guide linkage is the same as the preferred embodiment of FIG. 1. Load resistance pulley 56 is connected to crank arms 70,72. Ellipse 2 is shown in the cross train position of control arm 50. Note that the minor axis of ellipse 2 is higher than the minor axis of the preferred embodiment ellipse 5. The angle of pedal 16 to the floor is higher in this embodiment than the preferred embodiment. Movement of actuator extension 52 causes the pedals 14,16 to change positions similar to the preferred embodiment.

In summary, the present invention has distinct advantages over prior art because the guide linkage provides attractive elliptical pedal motion with arm exercise. The guide linkage further allows the foot motion to be adjusted with movement of the control arm to a different position which can occur during operation of the exercise machine.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine comprising;

a framework configured to be supported by the floor;

a crank means rotatably connected to said framework, said crank means projecting outwardly therefrom on both sides thereof;

a pair of foot support members, each said foot support member having a first end and a second end, said first end operably associated with said crank means, such that said second end of said foot support member follows a generally back and forth movement when said crank means is rotated;

a pair of guide links, each guide link having a first and a second end, said second end of said foot support member connected to said guide link intermediate each end at a guide pivot;

a pair of first control links, each said first control link pivotally connected to said first end of said guide link and to said framework;

a pair of second control links, each said second control link pivotally connected to said guide link at said second end;

a control arm, said control arm operably associated with said second control link and said framework;

a pair of pedal means to support each foot, said pedal means attached to said foot support member;

said pedal means configured to move relative to said framework when the foot of the user is rotating said crank means whereby said pedal means follows an elongate curve.

2. The exercise machine according to claim 1 wherein said control arm is a portion of said framework, said second control link being pivotally connected to said framework.

3. The exercise machine according to claim 1 wherein said guide pivot follows a generally linear path.

4. The exercise machine according to claim 1 wherein said control arm is movable relative to said framework whereby said guide link may be raised or lowered allowing the orientation of said elongate path relative to the floor to be changed.

5. The exercise machine according to claim 4 further comprising an actuator means, said actuator means operably associated with said control arm and said framework;

a control system to operate said actuator means, said control system allowing the orientation of said elongate path relative to the floor to be changed during operation of said exercise machine.

6. The exercise machine according to claim 5 wherein said actuator means is a linear actuator pivotally connected to said control arm and to said framework.

7. The exercise machine according to claim 5 wherein said actuator means is a rotary actuator operably associated with said control arm and said framework.

8. The exercise machine according to claim 1 further comprising a load resistance means operably associated with said crank means.

9. The exercise machine according to claim 1 further comprising a means for arm exercise, said means for arm exercise operably associated with said second end of said foot support member.

10. The exercise machine according to claim 1 further comprising a pair of handle means for arm exercise, each said handle means attached to said first control link whereby said handle means movement is coordinated with said foot support member.

11. The exercise machine according to claim 1 further comprising a pair of roller means, each said roller means rotatably attached to said crank means for support of said first end of each said foot support member and;

a pair of intermediate links, each said intermediate link pivotally connected to said crank means and to one of said foot support members whereby said first end of said foot support follows an oval path.

12. The exercise machine according to claim 1 further comprising a pair of coupling links for each foot support member, said coupling links pivotally connected to said foot support member and to said crank means whereby said first end of said foot support follows an oval path.

13. The exercise machine according to claim 1 wherein said first end of said foot support member follows an arcuate path when said crank means is rotated.

14. The exercise machine according to claim 1 wherein said pedal means is attached to said foot support member non-aligned with said first and second end of said foot support member.

15. An exercise machine comprising;

a framework configured to be supported by the floor;

a crank means rotatably connected to said framework, said crank means projecting outwardly therefrom on both sides thereof;

a pair of foot support members, each said foot support member having a first end and a second end, said first end operably associated with said crank means, such that said second end of said foot support member follows a generally back and forth movement when said crank means is rotated;

a pair of guide links, each guide link having a first and a second end, said second end of said foot support member connected to said guide link intermediate each end at a guide pivot;

a pair of first control links, each said first control link pivotally connected to said first end of said guide link and to said framework;

a pair of second control links, each said second control link pivotally connected to said guide link at said second end;

a pair of pedal means to support each foot, said pedal means attached to said foot support member;

a control arm, said control arm pivotally connected to said framework and to said second control link;

an actuator means, said actuator means operably associated with said control arm and said framework;

said pedal means configured to move relative to said framework when the foot of the user is rotating said crank means whereby the angle of said pedal means relative to the floor may be changed during operation of said exercise machine by said actuator means.

16. The exercise machine according to claim 15 further comprising a control system to operate said actuator, said control system having an interface with the operator for selection of desired pedal motion.

17. The exercise machine according to claim 15 further comprising a means for arm exercise, said means for arm exercise operably associated with said second end of said foot support member.

18. The exercise machine according to claim 15 further comprising a pair of handle means for arm exercise, each said handle means attached to said first control link whereby said handle means movement is coordinated with said foot support member.

19. The exercise machine according to claim 15 further comprising a pair of roller means, each said roller means rotatably attached to said crank means for support of said first end of said foot support member and;

a pair of intermediate links, said intermediate link pivotally connected to said crank means and to each said foot support member whereby said first end of said foot support follows an oval path.

20. The exercise machine according to claim 15 further comprising a pair of coupling links for each foot support member, said coupling links pivotally connected to said foot support member and to said crank means whereby said first end of said foot support follows an oval path.

21. The exercise machine according to claim 15 wherein said first end of said foot support member follows an arcuate path when said crank means is rotated.

22. The exercise machine according to claim 15 wherein said pedal means is attached to said foot support member non-aligned with said first and second end of said foot support member.

23. An exercise machine comprising;

a framework configured to be supported by the floor;

a crank means rotatably associated with said framework, said crank means positioned rearward the operator projecting outwardly therefrom on both sides thereof;

a pair of foot support members, each said foot support member having a first end and a second end, said first end operably associated with said crank means, such that said second end of said foot support member follows a generally back and forth movement when said crank means is rotated;

a pair of guide linkage comprising a plurality of links, each guide linkage connected to said second end of said foot support member at a guide pivot;

a pair of pedal means to support each foot, said pedal means attached to said foot support member;

a pair of handle means, said handle means operably associated with said guide linkage for arm exercise;

a control arm, said control arm operably associated with said guide linkage;

an actuator, said actuator operably associated with said control arm and said framework;

said pedal means configured to move relative to said framework when the foot of the user is rotating said crank means whereby the handle motion remains coordinated with said pedal means during activation of said actuator while said exercise machine is in operation.

24. The exercise machine according to claim 23 wherein said crank means further comprises a pair of roller means, each said roller means rotatably attached to said crank means to support said first end of said foot support member and;

a pair of intermediate links, each said intermediate link pivotally connected to said crank means and to one said foot support members.

25. The exercise machine according to claim 23 wherein said crank means further comprises a pair of coupling links for each foot support member, said coupling links pivotally connected to said foot support member and to said crank means.

26. The exercise machine according to claim 23 wherein said first end of said foot support member follows an arcuate path when said crank means is rotated.

27. The exercise machine according to claim 23 wherein said guide linkage comprises a guide link, said guide link having a first and a second end, said second end of said foot support member connected to said guide link intermediate each end at said guide pivot;

a pair of first control links, each said first control link pivotally connected to said first end of said guide link and to said framework;

a pair of second control links, each said second control link pivotally connected to said guide link at said second end and to said control arm.

28. The exercise machine according to claim 23 wherein said guide pivot follows a generally linear path.

29. The exercise machine according to claim 23 wherein said pedal means is attached to said foot support member non-aligned with said first and second end of said foot support member.

30. The exercise machine according to claim 23 further comprising a control system to operate said actuator, said control system having an interface with the operator for selection of desired pedal motion.

* * * * *